US009523177B2

(12) United States Patent
Snethun

(10) Patent No.: US 9,523,177 B2
(45) Date of Patent: Dec. 20, 2016

(54) PILING BOOT

(71) Applicant: Donald Andrew Snethun, Buck Lake (CA)

(72) Inventor: Donald Andrew Snethun, Buck Lake (CA)

( * ) Notice: Subject to any disclaimer, the term of this patent is extended or adjusted under 35 U.S.C. 154(b) by 0 days.

(21) Appl. No.: 14/081,890

(22) Filed: Nov. 15, 2013

(65) Prior Publication Data

US 2014/0131956 A1 May 15, 2014

Related U.S. Application Data

(60) Provisional application No. 61/727,028, filed on Nov. 15, 2012.

(51) Int. Cl.
*F16J 3/00* (2006.01)
*E02D 5/72* (2006.01)

(52) U.S. Cl.
CPC ..... *E02D 5/72* (2013.01)

(58) Field of Classification Search
CPC ..... F16J 3/041; F16J 3/042; F16J 3/043; E02D 5/72; E21B 33/02; E21B 33/03; E21B 33/035
USPC ..... 277/636, 634, 315, 391, 322, 323, 328,277/343, 344; 52/198, 199, 219
See application file for complete search history.

(56) References Cited

U.S. PATENT DOCUMENTS 354,560 A * 12/1886 Levier ..... F16L 37/091 285/371
2,724,156 A 11/1955 Shaw
3,630,037 A 12/1971 Howard
4,120,129 A * 10/1978 Nagler ..... E04D 13/1407 285/4
4,210,002 A * 7/1980 Dore ..... F16D 3/224 464/175
4,585,681 A 4/1986 Kidera et al.
4,818,148 A 4/1989 Takeda et al.
4,991,457 A * 2/1991 Chen ..... F16H 59/0213 277/640
5,010,700 A * 4/1991 Blair ..... E04D 13/1476 285/42
5,108,227 A 4/1992 Bergey
5,347,776 A * 9/1994 Skoff ..... 52/219
5,564,413 A 10/1996 Hori et al.
6,122,870 A * 9/2000 Marcum ..... 52/219
6,139,027 A * 10/2000 Biekx ..... 277/634
6,616,381 B2 9/2003 Larsen, Jr.
7,775,005 B2 * 8/2010 Johnston et al. ..... 52/219
8,256,184 B2 9/2012 Lowe
(Continued)

FOREIGN PATENT DOCUMENTS

JP 56100926 8/1981

OTHER PUBLICATIONS

Toroid merriam.*

*Primary Examiner* — Kristina Fulton
*Assistant Examiner* — Nathan Cumar
(74) *Attorney, Agent, or Firm* — Richard D. Okimaw

(57) ABSTRACT

An apparatus for sealing a piling to a planar member extending around the piling comprises a base collar sized to surround the piling at a first location and having a planar base flange extending therefrom and an upper collar sized to extend around the piling at a second location, the upper collar being sealable around the piling. A longitudinally extendable sleeve extends between the base collar and the upper collar sealing the base collar to the upper collar.

9 Claims, 5 Drawing Sheets

(56) References Cited

U.S. PATENT DOCUMENTS

2006/0088386 A1 4/2006 Ellis

* cited by examiner

PILING BOOT

CROSS REFERENCE TO RELATED APPLICATION

This application claims priority from U.S. Provisional Patent Application No. 61/727,028 filed Nov. 15, 2012 entitled Piling Boot.

BACKGROUND OF THE INVENTION

1. Field of Invention

The present invention relates to sealing members in general and in particular to a method and apparatus for sealing around a ground piling.

2. Description of Related Art

In many industries, storage tanks are utilized to store or otherwise contain a variety of fluids. Some of such fluids may be hazardous or otherwise polluting to the environment, such as, by way of non-limiting example diesel fuel, glycol, or other chemicals utilized for industrial or commercial applications. Disadvantageously, such storage tanks may periodically have leaks, spills or other failures which may lead to contaminants entering the local soil and polluting the environment.

One common method of reducing possible impact of contaminant spills has been to place the storage tank on pilings inserted into the soil and to then also cover the surrounding soil with a ground sheet. As the ground sheet is required to contain any contaminants escaping from the storage tank, it has commonly been necessary to seal the ground sheet around piling. Previous solutions to the above difficulty have been to seal the ground sheet directly to the piling or to provide a collar extending from the sheet which may then be sealed to the piling.

One disadvantage of such a system is the difficulty of maintaining the seal between the ground sheet and the pilings. In many locations, the ground surrounding such storage tanks may be prone to expansion, contraction, shifting or settling due to the influence of time, water infiltration or ground freezing and thawing. Such fluctuations in ground level may cause the ground sheet to move relative to the pilings making sealing such ground sheet around the pilings difficult. As the connection between the ground sheet and the piling may become stretched due to the movement of the ground sheet past the strength limits of the connection or the ground sheet.

SUMMARY OF THE INVENTION

An apparatus for sealing a piling to a planar member extending around the piling. The apparatus comprises a base collar sized to surround the piling at a first location and having a planar base flange extending therefrom and an upper collar sized to extend around the piling at a second location, the upper collar being sealable around the piling. The apparatus further comprises a longitudinally extendable sleeve extending between the base collar and the upper collar, the sleeve sealing the base collar to the upper collar.

The sleeve may comprise a cylindrical bellows. The sleeve may comprise tubular member having an s-shaped wall cross-section. The sleeve may be sealable to the base collar and upper collar. The sleeve may be integrally formed with the base collar and upper collar.

The base flange may extend substantially perpendicularly from the base collar. The base flange may have a substantially rectangular outer edge.

The upper collar may be sealed around the piling by a clamp. The clamp may comprise a hose clamp. The base flange may be sealed to the ground sheet.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
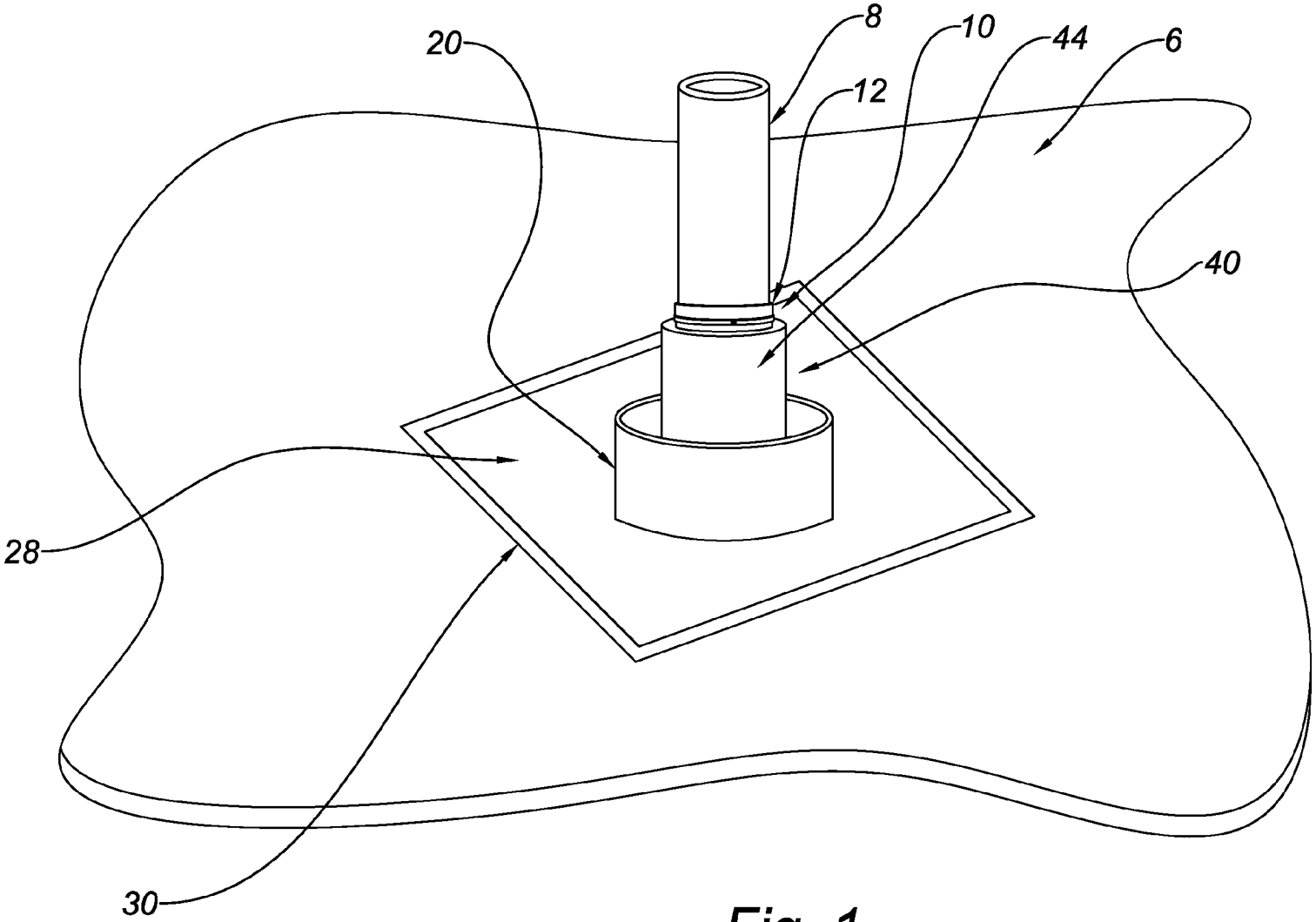
FIG. 1 is a perspective view of a piling and ground sheet having an apparatus for sealing the piling to the ground sheet according to a first embodiment of the present invention applied thereto.

Referring to FIG. 1, an apparatus for sealing around a piling 8 to a ground sheet 6 according to a first embodiment of the invention is shown generally at 10. The apparatus a top collar 12, a base collar 20, and a longitudinally extendable sleeve 40 extending therebetween. The base collar 20 surrounds the piling and includes a flange 28 extending substantially radially therefrom. The top collar is sealably secured to the piling such that the apparatus seals the ground sheet around the piling so as to prevent contaminants from escaping the ground sheet past the penetration through ground sheet provided for the piling.

Figure 2:
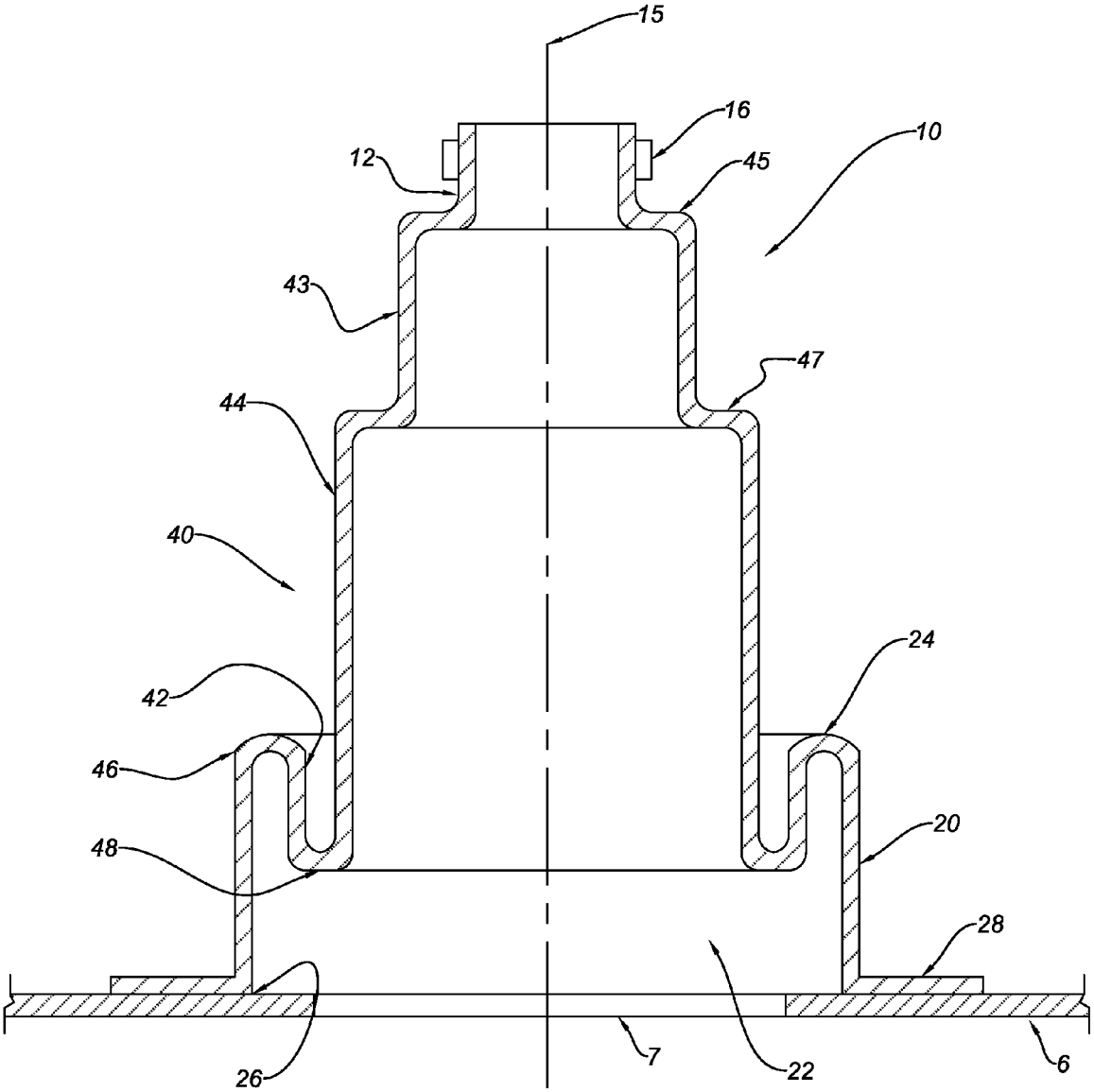
FIG. 2 is a cross sectional view of the apparatus of FIG. 1 as taken along the line 2-2 at a first or retracted position.
Figure 3:
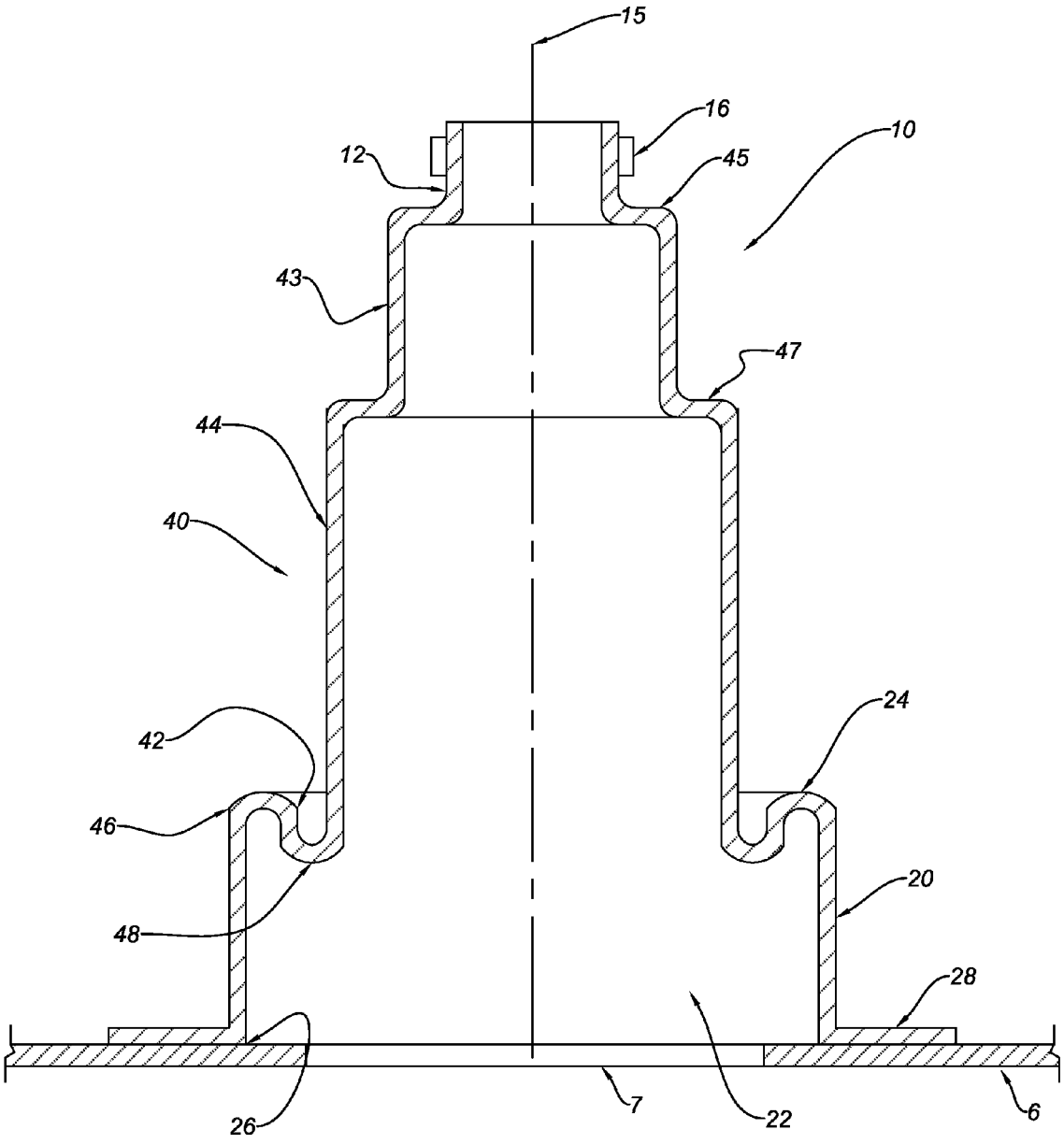
FIG. 3 is a cross sectional view of the apparatus of FIG. 1 as taken along the line 2-2 at a second or extended position.

With reference to FIGS. 2 and 3, the top collar 12 comprises a substantially tubular member defining a central passage 14 therethrough and may be secured to the piling with a hose clamp 16 or the like. The central passage 14 may be substantially circular, rectangular or any other shape so as to correspond to the outer surface of the piling. The clamp 16 may comprise any suitable clamping member, such as by way of non-limiting example, a hose clamp, band clamp or the like. Optionally, the top collar 12 may be secured to the piling by any other known method, such as, by way of non-limiting example, adhesives, welding or the like. The central passage 14 may be sized to be slightly larger than the outer surface of the piling so as to facilitate installation thereover or may also optionally have an interference fit with the piling. The top collar 12 may be formed of any suitable material, such as by way of non-limiting example, metal, plastic, natural or synthetic rubbers or composite materials. In particular, it has been found that forming the top collar 12 of high density polypropylene has been particularly useful. The top collar may have any length as is necessary to provide a secure fitting and seal around the piling, such as, by way of non-limiting example, between 2 and 16 inches (51 and 406 mm) although it will be appreciated that other lengths may be useful as well.

The base collar 20 comprises a substantially tubular member extending between top and bottom ends, 24 and 26, respectively and having a central passage 22 extending therethrough. The base collar 20 includes a flange 28 extending substantially radially from the bottom end 26 of the base collar for securing to the ground sheet 6 as will be further described below. The central passage 22 may be substantially circular, rectangular or any other shape so as to correspond to the outer surface of the piling and is sized so as to surround the piling without engaging thereon. In such a manner it will be observed that the central passage 22 and also the base collar 20 are freely movable relative to the piling. The base collar 20 may be formed of any suitable material, such as by way of non-limiting example, metal, plastic, natural or synthetic rubbers or composite materials. In particular, it has been found that forming the base collar 20 of high density polypropylene has been particularly useful. The bottom collar may have any length as is desired by a user, such as, by way of non-limiting example, between 2 and 16 inches (51 and 406 mm) although it will be appreciated that other lengths may be useful as well.

The flange 28 comprises a sheet of material extending substantially radially from the bottom end 26 of the base collar 20. The flange 28 may have any outline as desired by a user, such as, by way of non-limiting example, circular, square, octagonal, triangular or irregular. The flange may be formed of any suitable material, such as by way of non-limiting example, metal, plastic, natural or synthetic rubbers or composite materials. In particular, it has been found that forming the flange 28 of high density polypropylene has been particularly useful. The flange 28 may be formed separately from the base collar 20 and thereafter secured to by way of welding, adhesives or the like or may optionally be co-formed with the bottom collar. As illustrated in FIG. 1, the flange 28 may include an outer edge portion 30 which may be utilized to be sealably secured to the ground sheet 6 by adhesives, plastic welding or the like as is commonly known in the art.

The sleeve 40 is formed of an outer, or first tubular portion 42, and an inner, or second tubular portion 44 which are co-axial with each other about a central axis 15 of the apparatus. As illustrated in FIG. 2, the base collar 20, and first and second tubular portions 42 and 44 form an s-shaped cross-section which permits the apparatus to longitudinally extend along its axis 15. The sleeve 40 may be formed of any suitable material, such as by way of non-limiting example, metal, plastic, natural or synthetic rubbers or composite materials. In particular, it has been found that forming the sleeve 40 of high density polypropylene has been particularly useful. The sleeve may be formed separately from the base collar 20 and the top collar 12 and thereafter secured to by way of welding, adhesives or the like or may optionally be co-formed with the bottom collar.

As illustrated in FIGS. 2 and 3, the sleeve may further include additional one or more additional secondary tubular portion 43 offset from the second tubular portions 42 with a step 47. Similarly the additional secondary tubular portion 43 and the top collar 12 may be offset by a step 45. The additional secondary tubular portions 43 and the second tubular portions 44 provide additional diameters which may be utilized as the top collar. In particular the sleeve may be cut along the additional secondary tubular portion 43 proximate to the step 45 such that the additional secondary tubular portion 43 then forms the top of the apparatus. In such configuration, the additional secondary tubular portion 43 will then form the top collar for use with a larger diameter piling. It will be appreciated that a plurality of such additional secondary tubular portions 43 may be utilized so as to accommodate a plurality of potential piling diameters. Additionally, the second tubular portion 44 may also be cut proximate to the step 47 so as to cause the second tubular portion 44 to form the top collar.

As illustrated the first and second tubular portions 42 and 44 may be co-formed with the base collar 20 with a first radiused bend 46 located between the base collar 20 and the first tubular portion and a second radiused bend 48 located between the first and second tubular portions 42 and 44. As the piling 8 is moved in an upward direction, generally indicated at 50 in FIG. 3, relative to the ground sheet the second radiused bend 48 may be shifted along the sleeve so as to shorten the first tubular portion 42 and lengthen the second tubular portion 44 due to the deformation of the sleeve. While undergoing such movement, it will be appreciated that the piling 8 will move freely upward relative to the base collar 20 and the ground sheet 6 while moving through a bore 7 in the base sheet 6. It will also be appreciated that other deformations within the sleeve 40 may be possible to permit such free movement of the top collar 12 relative to the base collar 20.

In operation, a user may place the assembled or preformed apparatus 10 around the piling after piling has been driven into the ground and the ground sheet has been located around the base of the piling. In such a configuration, the piling 8 will extend through a bore 7 in the ground sheet 6 and be unconnected thereto. After locating the apparatus 10 around the piling 8, the user may seal the top collar to the piling with a hose clamp 16 or the like and may then seal the outer edge 30 of the flange 28 to the ground sheet 6 through adhesives, welding or the like. Thereafter, the apparatus will maintain the seal of the ground sheet 6 around the piling 8 during movement of the underlying soil structures due to frosts, soil erosion or the like and thereby prevent spills of any contaminants. As illustrated the apparatus 10 has a substantially cylindrical profile so as to surround a tubular piling 8 however it will be appreciated that other cross-section profiles, such as, by way of non-limiting example, square, triangular, octagonal or irregular may also be utilized so as to conform to the cross-section of the piling.

Figure 4:
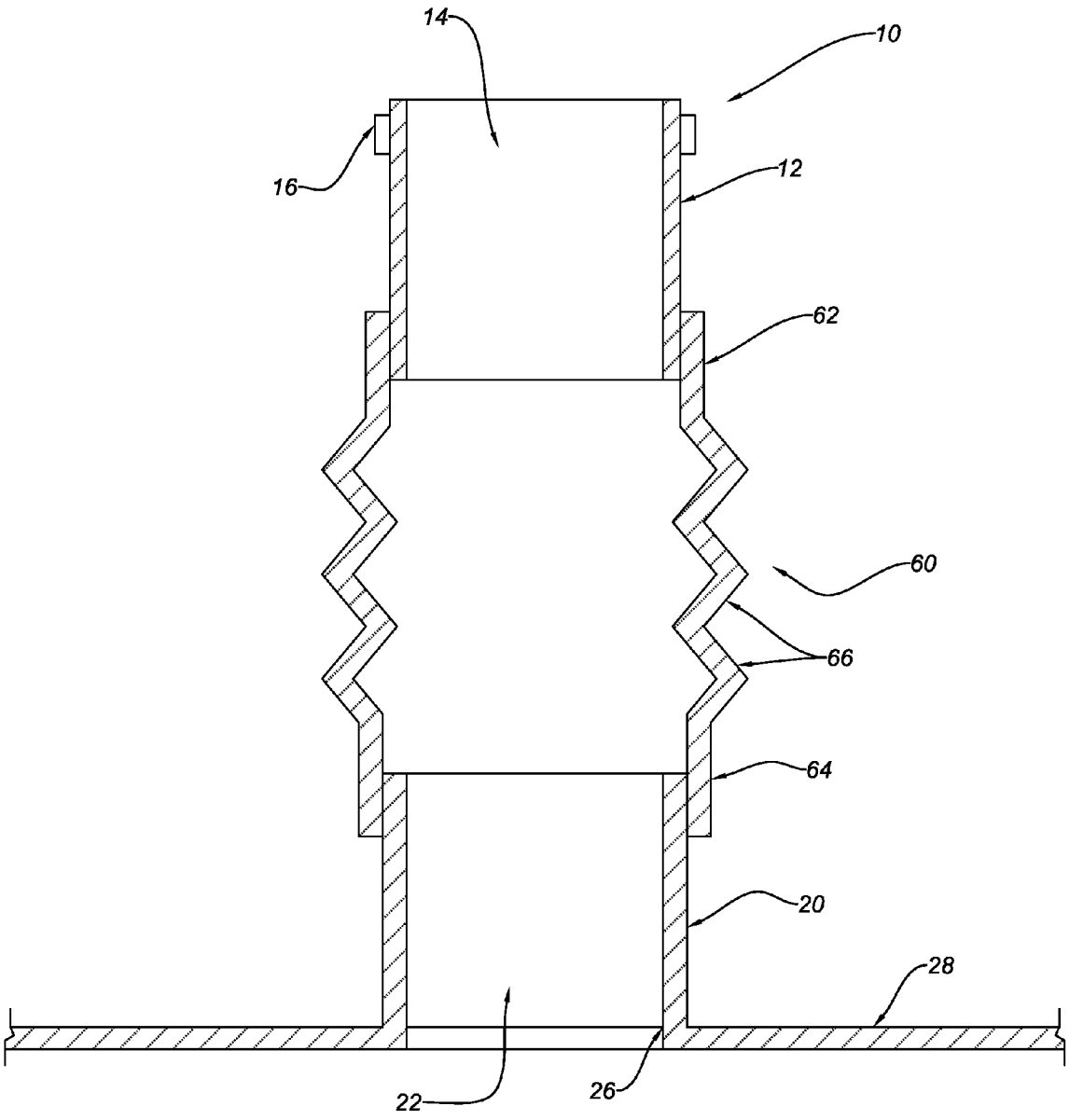
FIG. 4 is a cross sectional view of the apparatus of FIG. 1 as taken along the line 2-2 according to a further embodiment of the present invention.
Figure 5:
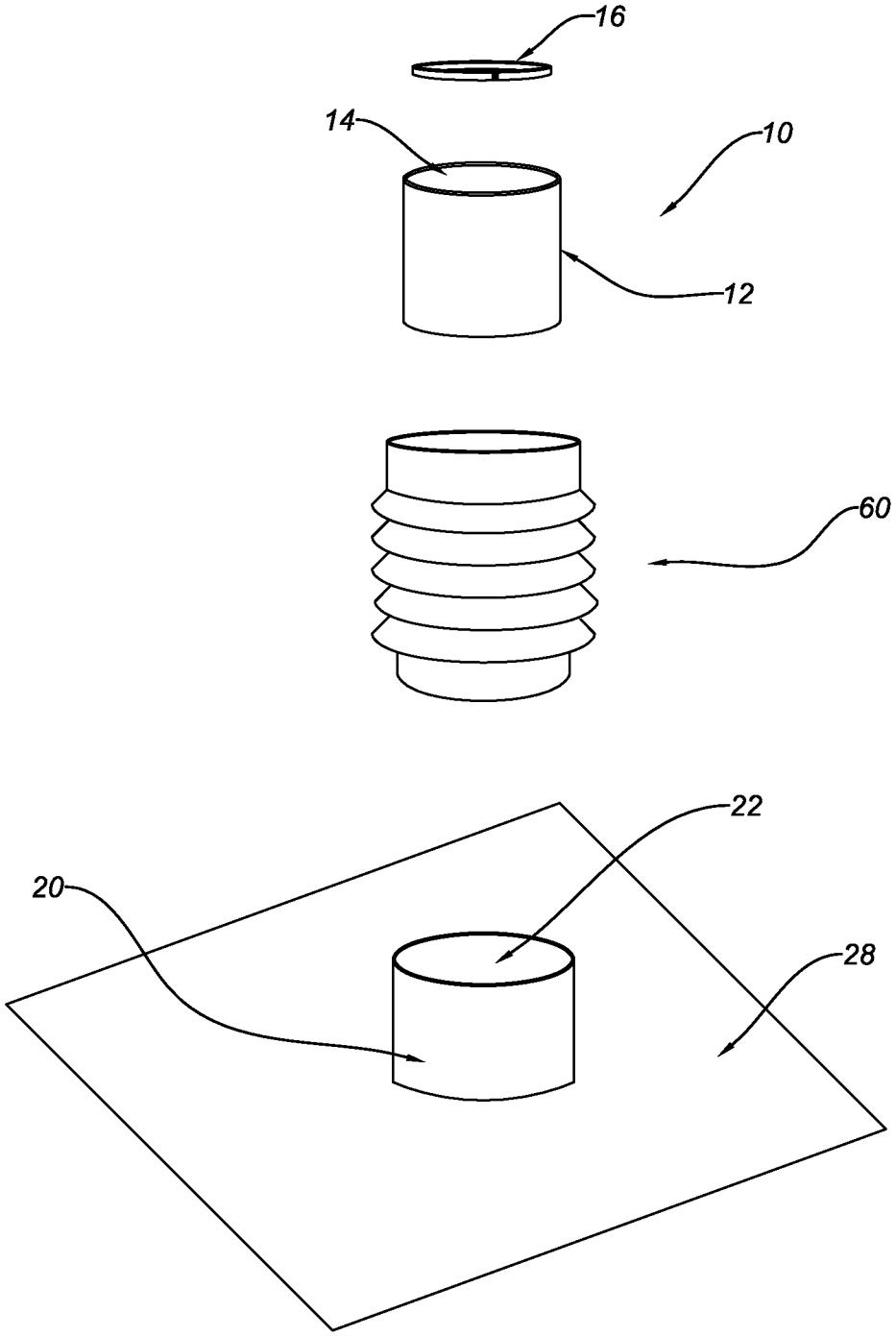
FIG. 5 is an exploded perspective view of the apparatus of FIG. 4.

With reference to FIGS. 4 and 5, an alternative embodiment of the present invention is illustrated. As illustrated in FIGS. 4 and 5, the apparatus may include top and base collars 12 and 20 as set out above with an longitudinally expandable sealing member 60 therebetween. The seal member 60 may be formed of first and second end sleeves, 62 and 64, respectively and a corrugated or bellows section 66 therebetween. The corrugated section 66 is longitudinally extendable along the axis 15 of the apparatus 10 as set out above. The corrugated section 66 may be formed integrally with the top and base collars 12 and 20 or may optionally be formed separately therefrom and thereafter connected to the top and bottom sleeves by adhesives fasteners or the like.

The apparatus 10 may be formed of any suitable material, such as by way of non-limiting example, metal, plastic, natural or synthetic rubbers or composite materials. In particular, it has been found that forming the apparatus of high density polypropylene has been particularly useful. The separate elements of the apparatus 10 may be formed separately and thereafter secured to each by way of welding, adhesives or the like or may optionally be co-formed with the bottom collar.

While specific embodiments of the invention have been described and illustrated, such embodiments should be considered illustrative of the invention only and not as limiting the invention as construed in accordance with the accompanying claims.

What is claimed is:

1. An apparatus for sealing a piling to a planar member extending around the piling, the apparatus comprises:

a base collar sized to surround the piling at a first location and having a planar base sheet extending perpendicularly therefrom;

an upper collar sized to extend around the piling at a second location, said upper collar being sealable around the piling; and a longitudinally extendable sleeve extending between said base collar and said upper collar, said sleeve sealing said base collar to said upper collar, wherein said longitudinally extendable sleeve comprises first and second tubular portions such that said first tubular portion is located axially inside said base collar having a partial toroidal connection therebetween and such that said second tubular portion is located axially inside said first tubular portion having a partial toroidal connection therebetween, and wherein said first and second tubular portions and said base collar have walls parallel to each other and wherein each of said first and second tubular portions and base collar extend along a common axis and have substantially consistent cross sections along said axis.

2. The apparatus of claim 1 wherein said sleeve comprises a cylindrical bellows.

3. The apparatus of claim 1 wherein said sleeve comprises tubular member having an s-shaped wall cross-section.

4. The apparatus of claim 1 wherein said sleeve is sealably connected to said base collar and said upper collar.

5. The apparatus of claim 1 wherein said sleeve is integrally formed with said base collar and said upper collar.

6. The apparatus of claim 1 wherein said base flange extends substantially perpendicularly from said base collar.

7. The apparatus of claim 6 wherein said base flange has a substantially rectangular outer edge.

8. The apparatus of claim 1 wherein said upper collar is sealed around the piling by a clamp.

9. The apparatus of claim 8 wherein said clamp comprises a hose clamp.

* * * * *